US010252898B2

(12) United States Patent
Ribi

(10) Patent No.: US 10,252,898 B2
(45) Date of Patent: Apr. 9, 2019

(54) PLANT FOR APPLYING PROTECTIVE MEMBRANES ON BEVERAGE CANS

(71) Applicant: RIBI PACK SPA, Genoa (IT)

(72) Inventor: Léon Antoine Ribi, Massongex (CH)

( * ) Notice: Subject to any disclaimer, the term of this patent is extended or adjusted under 35 U.S.C. 154(b) by 609 days.

(21) Appl. No.: 14/774,631

(22) PCT Filed: Mar. 13, 2013

(86) PCT No.: PCT/IB2013/051966

§ 371 (c)(1),
(2) Date: Sep. 10, 2015

(87) PCT Pub. No.: WO2014/140690

PCT Pub. Date: Sep. 18, 2014

(65) Prior Publication Data

US 2016/0031691 A1 Feb. 4, 2016

(51) Int. Cl.
*B67B 5/03* (2006.01)

(52) U.S. Cl.
CPC ..... *B67B 5/034* (2013.01)

(58) Field of Classification Search
CPC ..... B65B 53/00; B65B 35/26; B67B 5/00; B67B 5/034
USPC ..... 53/287, 329, 329.4, 556, 129.1, 135.1, 53/136.1, 286
See application file for complete search history.

(56) References Cited

U.S. PATENT DOCUMENTS 1,238,713 A * 8/1917 Johnson et al. ..... B65C 1/042 156/483
2,042,304 A * 5/1936 Glunz ..... B67B 3/026 53/359
2,103,302 A * 12/1937 Strout ..... B67B 5/038 53/291
2,146,347 A * 2/1939 Pityo ..... B67B 3/02 215/326
2,297,720 A 10/1942 Schmutzer et al.
4,104,845 A * 8/1978 Hoffmann ..... B67B 5/032 53/297
7,534,124 B1 * 5/2009 Lemaire ..... H01R 13/193 439/263

FOREIGN PATENT DOCUMENTS

DE 2724226 A1 12/1977
DE 202005001602 U1 11/2005
GB 871031 A 6/1961
GB 2151592 A 7/1985

* cited by examiner

*Primary Examiner* — Andrew M Tecco
*Assistant Examiner* — Nicholas Igbokwe
(74) *Attorney, Agent, or Firm* — Themis Law

(57) ABSTRACT

A rotating plant for the application of protective membranes of a stretchable plastic polymer on the upper rim of beverage cans includes equal operating devices movable along radial trajectories of a turntable that provide for the circular movement, the radial movement and the vertical movement required and sufficient for applying the membranes.

12 Claims, 5 Drawing Sheets

PLANT FOR APPLYING PROTECTIVE MEMBRANES ON BEVERAGE CANS

FIELD OF THE INVENTION

The present invention relates to a system and plant for applying protective membranes on beverage cans.

BACKGROUND OF THE INVENTION

The use of cans such as pull-tab quick opening metal sealed containers has been fast growing for some decades because of their efficacy.

Moreover, the manufacture of said cans is implemented by now and it follows general processes that have found both the acceptance by customers and acceptable packaging costs.

The use of metal instead of plastic polymers for making said containers, among other things, allows a particularly environmentally-friendly recycling of the base material unlike the containers made of plastic materials.

In time, however, sanitary problems have arisen that currently are still unsolved, particularly those related to the opening of the cans. The simple fact of pouring the beverage in a glass from a torn opening whose outer surface may have been contaminated formerly, or even worse the fact of drinking directly from the torn opening can result in severe oral or gastrointestinal infections.

In the last years, contaminations of the external surfaces of cans have taken place due to various microbial strains and particularly contaminations by microbial strains of leptospirosis, probably occurred during the storage of the cans in unhygienic rooms, especially under hot climates and in the possible presence of rats.

SUMMARY OF THE INVENTION

The present invention relates to a plant intended to apply without using adhesives a waterproof membrane of a suitable plastic polymer, or seal, which covers and strongly adheres to the upper circular rim of the can and so it is intended to protect also the pull-tab opening of the can. Previous attempts have been made with plastic covers (caps) forced on the upper rim of the cans or with aluminum metal covers, even glued ones, which however besides being more expensive they have also a poor sealing effect, and therefore they are not so much effective in preventing contaminated liquids or condensations from infiltrating.

DETAILED DESCRIPTION OF A PREFERRED EMBODIMENT

A plant according to the present invention is essentially composed of a turntable 1 rotating around an axis, which is made of two flat rigid rings 2,3, integral with each other, connected to said axis, which is driven by an electric motor, also by a transmission toothed belt 4, equipped with the relevant running, stopping and controlled speed controls.

Each of the two rings 2, 3 bears an equal number of radial rails or guides 5 in a variable number, depending on the size of the plant, integral with said two rings 2,3 and having angular distances therebetween that are all equal and constant in both the rings 2,3, while each guide 5 of the upper ring 2 is located on the same vertical radial plane of a guide 5 of the lower ring 3.

An operating device 6 corresponds to each pair of guides 5 or rails lying on the same vertical plane, it is radially movable along said two guides 5, and is intended to grasp, retain, seal and subsequently release the cans 7 on whose top the protective membrane 8 has been applied.

This operating device 6 is intended to translate the cans 7, pushing them vertically, by means of a vertical rod 9 equipped with a suitable plate 10 arranged on the upper end and with a caged lubricated rotating ball 11 at the lower end.

The vertical motion takes place by means of a track 12 that is rigid and integral with the base frame, about twenty millimeters wide, whose central axis lies on the surface of a cylinder with a diameter anyway greater than those of the two rings 2,3 and upon which a lubricated ball 11 caged on the vertical rod 9 of the operating device 6 slides. Said closed annular track 12, without interruptions, obviously develops along a continuous plane that changes in level with several slopes between a horizontal higher level and a lower one, and thus behaves like a cam that causes said vertical motion of the rods 9 by means of the rotation of the two rings 2, 3 that drive all the operating devices 6.

Moreover said operating devices 6 are radially movable along said guides 5 by means of the action of horizontal rolling bearings 13 mounted at the end of arms 14 integral with the operating devices 6, which slide inside an annular groove, formed in a flat ring, with a variable diameter and a constant width only higher than the diameter of said bearings 13, which ring with the relevant groove is also integral with the base frame. Said groove behaves like a horizontal cam for changing the radial widths of the operating devices 6.

The Turntable

The turntable 1 is composed of two rigid horizontal rings 2, 3 held together by webs 17 such to form a rigid rotating structure. Said rotating structure is supported by other three rings 18, 19, 20, integral one with the other of which the two lower ones 18, 20 bear a circular groove 21 that slides on balls that in turn slide in a groove 22 obtained on the outer surface of a base ring or disc. The drive, by means of a toothed belt 4, is applied on the outer surface of the intermediate ring 19. On the two rigid rings 2,3 there are radial guides 5 translating the operating devices 6. Said guides 5 are angularly equally spaced from each other and all the guides 5 of the upper ring 2 are at the precise vertical of the same number of corresponding guides 5 attached to the lower ring 3.

The rotation of the turntable 1 is preferably guaranteed by a powered electric motor that transmits the rotation to the turntable 1 through said toothed belt 4.

Moreover, fastened to or attached to the base structure of the plant supporting the turntable 1, there are provided:

1) A series of operating devices 6;

2) A variable level track 12, acting as a vertical cam with a diameter greater than that of the two rings 2 and 3 that allows the rods 9 of the operating devices 6 to vertically move;

3) A programmed profile horizontal cam which controls the opening and closing of the upper clamp 23;

4) A horizontal cam in the form of a groove and with a preferably rectangular section formed in a rigid ring for radially moving the operating devices 6;

5) A circular horizontal cam with a variable radius profile for controlling the linkage;

6) A plate with a lead-in for receiving the output sealed cans 7 and for directing them to the output rotating star 27;

7) A horizontal circular duct equipped with a longitudinal slit for feeding hot air or a similar device.

The Operating Device

The operating devices 6 are the movable members that circularly, radially and vertically move the cans 7 during the sealing operation.

Said operating devices 6 rotate driven by what we have called a "turntable" 1, which, as shown, is composed of two rings 2, 3 connected one to the other by spacing webs 17, which are equipped with two radial superimposed guides 5 for each operating device 6, said turntable 1 being driven by an electric motor 69 powered by a toothed belt 4.

The cans 7, therefore, transported by said operating devices 6 can contemporaneously move circularly, radially and vertically.

Each operating device 6 is essentially composed of a rigid structure bearing two horizontal superimposed and parallel saddles 28, configured to move along two of the superimposed guides 5 of the turntable 1. Said saddles 28 have a dovetail male portion which will slide in the dovetail female portion of the guides 5.

The lower portion of each of the rigid structures bears an arm, near to the distal part of the lower guide 5, equipped with a horizontal rolling bearing 13 intended to be housed in the groove of the horizontal static cam, which, by the rotating motion of the turntable 1, provides the radial translation motion of the operating device 6.

At the opposite side of the position of the horizontal bearing 13 of each operating device 6 the rigid structure bears a vertical guide 29, along which a rod 9 slides, at the upper end of which a plate 10 is located intended to push the bottom of the cans 7, while at the lower end there is a lubricated cage containing, in a tight manner, a ball 11 able to freely rotate in the cage.

Said ball 11 is intended to roll on a variable level closed track 12 along a trajectory, whose vertical projection is on a circle except for a lower horizontal straight portion corresponding to a chord of said circle. The chord concerned encompasses an arc of a circle variable about 60°.

At a level between the lower saddle 28 and the upper one 28 the rigid structure bears a sort of horizontally opening elastic clamp 30 having two self-lubricating plastic polymer jaws whose inner shapes are fittable to the cylindrical area of the cans 7 along a development arc, opposite to its opening, only higher than 180°.

Thus said clamp 30 enables the can 7 to be laterally inserted by a simple lateral pressure, made by a star-like rotor 66, while the holding is guaranteed by an adjustable spring located at the part opposite to its opening with respect to its fulcrum.

The pressure of the clamp 30 on the cylindrical wall of the can 7 is such to allow it to vertically upwardly slide due to the vertical rod 9 pushing it when said rod 9 is forced to lift due to the ball 11 rolling along the cam track 12.

The rigid structure at its upper part bears another sort of clamp 23 equipped with two jaws whose inner shape is similar to that of the lower clamp 30.

The opening and closing of its jaws, unlike the lower clamp 30, is driven by a rod 33, which bears at its end a horizontal bearing 34 sliding along a circular profile or stationary cam, integral with the base frame. Said rod 33 is pushed during the rotation of the turntable 1 towards the outside by the stationary cam and towards the inside by a compression coil spring 36 surrounding the rod 33 itself, compressed between the fork 37 supporting the horizontal bearing 34 and the rigid structure of the operating device 6.

The rod 33 is integral with a wedge 38 coaxial thereto, whose two sloped planes are vertical and symmetric with respect to the axis of the rod 33.

The two driving arms 39 of the clamp 23 are articulated on a fulcrum integral with the structure of the operating device 6.

At the end of the two arms 39 of the clamp 23 there are two vertical cylindrical pawls 41 mounted on two pins. Said pins arranged on the end of the arms 39 of the clamp are connected to each other by one or two tension coil springs 40. Said pawls 41 are always in contact with the rod 33 whose section is locally quadrangular or with the sloped sides of the wedge 38. When the rod 33 is pushed by the stationary cam by the horizontal bearing 34, the two pawls are moved away from each other by the inclined surfaces of the wedge 38, thus allowing the clamp 23 to close, while when the rod 33 is pushed in an opposite direction by the compression coil spring 36, the two pawls 41 move down along the sloped walls of the wedge 38, thus allowing the clamp 23 to elastically open by means of the return springs 40.

In the gap between the two clamps 23 and 30 there is the gripper 42 for gripping the plastic polymer tape 43 to be applied as a seal on the upper rim of the cans 7.

The gripper 42 is composed of a fixed part integral with the rigid structure of the operating device 6 at the top it is composed of a first rigid ring **42*s*, with an inner diameter higher than that of the can 7 which is connected, by four columns 45 or vertical spacers, to a second horizontal ring 42*i*, parallel to the first one, which in the lower part is equipped with a circular groove 46 housing an annular seal. Underneath and adherent to the upper fixed part of the gripper 42, namely under the ring 42*s*, there is the hot air diffuser 44 that serves for circularly cutting the scrap of the plastic polymer membrane. A lip seal 47 made of heat resistant plastic material is engaged to the first upper ring 42*s*, whose inner diameter faces the upper aperture of the diffuser 44 such to leave the cans 7** to pass in contact.

The gripper 42 further comprises a rigid member 48, vertically movable, that can slide along a vertical guide fastened to the rigid structure of the operating device 6. This movable rigid member 48 is integral, at its upper end, with another rigid horizontal ring 49, integral thereto, which bears at its upper surface a concentric ring 70 having a diameter equal to that of the ring **42*i*, which is also equipped with a circular groove 46 equal to that of the ring 42*s*, which houses another annular seal. The rim of the holes of the rigid ring 42*i* and of the ring 70 fastened on the top of the ring 49 are suitably rounded such to better stretch the plastic polymer tape to operate as a protective membrane 8 applied to the cans 7**.

In order to close the jaws of the gripper 42 the rigid vertical member 48 bearing the lower horizontal rigid ring 49, that is the lower jaw, has to be lifted. The upward movement, as downward movement, is caused by a "L" shaped linkage 50 having its fulcrum at its angle. The vertical arm 51 can be pushed, causing the gripper 42 to open, by the rod equipped with the bearing 53, which is pushed by the circular stationary cam, or it can be pulled, causing the gripper 42 to close, by return coil springs 55, anchored to the rigid structure of the operating device 6. The end of the horizontal arm 56, on the contrary, is engaged between an adjustable strut 57 fitted in the movable vertical sliding member 48 and a striding element 58 it being also attached to said vertical member 48.

Underneath the first rigid perforated ring 42*s* of the fixed part of the gripper 42 there is provided a hot air diffuser 44 composed of a toroidal box, kept and placed concentric to the holes of the rings 42*s* and 42*i* by means of the four vertical columns, which is made with an externally closed torus shape made of sheet, which takes, on the outside, the shape of a mouth 59 whose horizontal opening, for simplicity reasons, is quadrangular and opens downwardly while the diameter of the circular opening of the torus is slightly higher than that of the cans 7 that pass through it.

The lower mouths 59 of the diffusers slide on a circular duct concentric with the turntable 1 bearing a continuous longitudinal slit that feeds hot air, while the contiguous side edges of each rectangular mouth bear two thin horizontal elastic blades that superimpose, by imbricating each other, the ones of the contiguous mouths 59, which reduce hot air leaks. Another way to feed the diffusers, in this case composed of tori made of a box-like sheet closed on the outside and opened on the inside, is to apply to them flexible hoses connected to a central dispenser located at the axis of rotation of the turntable 1, which dispenser enables hot air to pass with ports obstructable only when the diffusers 44 pass in the circular sector of the turntable 1 corresponding to the step cutting the plastic polymer tape 43.

Plant for Feeding the Stretchable Plastic Polymer Tape

The plant concerned is essentially composed of a reel 63 containing a tape 43 of stretchable plastic polymer and of a series of tension means 64 and tension adjusters, which enable the tape 43 to be laterally introduced between the jaws 42*i* and 70 of the gripper 42 that applies the seals. Therefore, the tape 43 arrives as tangent to the straight geometric chord where the cans 7 are aligned and here it is pinched by the jaws 42*i* and 70 of the gripper 42 and is applied by stretching it on the top of the cans 7, that is on their openings, due to the lifting of the cans 7 produced by the rod 9 of the operating device.

Firstly the cans 7 are fed linearly by an auger 65, then a star-like rotor 66 intercepts them and take the cans 7 from the auger 65, and finally it pushes them between the jaws of the elastic clamp 30 of the operating devices 6.

Plant Operation

The cans 7 are directed towards an auger 65, which moves them at the operating speed of the plant. The star-like rotor 66 synchronized with the auger 65 collects the cans 7 one by one and, rotating them of about 200°, fits them between the elastic jaws of the lower clamp 30 of the operating device 6. After a rotation of about 15° of the turntable 1, the groove-like stationary cam, by the bearing 13 of the arm 1, progressively slides along the radial guides 5 of the two rings 2, 3 of the turntable 1 the operating devices 6, which are forced to travel the cans 7 along a straight trajectory along a chord of the constant radius rotation circle of the trajectory of the cans 7.

Upon the entrance of the operating devices 6 in said straight trajectory the jaws of the grippers 42 open. Advancing along the trajectory of said chord the jaws of the grippers 42 progressively close thus pinching the tape 43 of stretchable plastic polymer, which meanwhile is introduced between the open jaws during the last curvature portion preceding the straight chord of the rotation circle of the cans 7.

Now, the vertical lifting rods 9, moved by the stationary cam 12 that increases its level by increasing its slope, push the cans 7 corresponding thereto upwardly causing them to slip between the jaws of their lower elastic clamps 30. With such vertical motion of the cans 7, the membrane 8 of the tape 43 of plastic polymer pinched between the jaws 42*i* and 70 of the closed gripper 42 is stretched on the upper rim of the cans 7 and here it adheres by an annular area reduction caused by the forced radial orientation of the molecules of the stretchable polymer.

Upon the arrival at a certain vertical programmed level the cans 7 are surrounded by the tori of the hot air diffusers 44 bordered at the top by the lip seal 47. Now the track 12 of the static cam acting on the rod 9 travels for an arc of a circle at a constant level and the cans 7 rotate with the turntable 1 on a horizontal plane.

During this arc of rotation on this horizontal plane the hot air flows into the diffusers 44, clear-cutting the membranes 8 applied exactly at the level of said lip seal 47.

Then the track of the static cam 12 raises again and the vertical rods 9 of the operating devices 6 push further upwardly the cans 7 now sealed between the open jaws at the proper location of the upper clamps 23 driven by the stationary cam 35 and by the coil return spring 36. Once the cans arrive at the highest programmed level the jaws of the clamps 23 close, while the track of the stationary cam 12 that drives the vertical rods 9 of the operating devices 6 stabilizes on said horizontal plane forcing the cans 7 to rotate with a constant radius going towards the exit of the turntable 1.

When the cans arrive at about 280° of rotation of the turntable 1, starting from the center)(0°) of the geometric chord, they fall on a plane, namely, a metal plate, which has a level lead-in which plane is flanked with a curved vertical wall. The cans 7 then are deviated from the trajectory of their rotation with constant radius of the turntable 1 and the jaws of the upper clamps 23 open by releasing them. Once released, a star-like rotor 27 collects them one by one and it sends them, aligned against a circular wall, to the exit where they can be removed by a conveyor belt. Once the cans 7 are on said metal plate 26 the track 12 of the cam setting the operating levels abruptly moves down with a sudden negative progressive slope to finally reach the lower base level by progressively reducing the negative slope.

Figure 1:
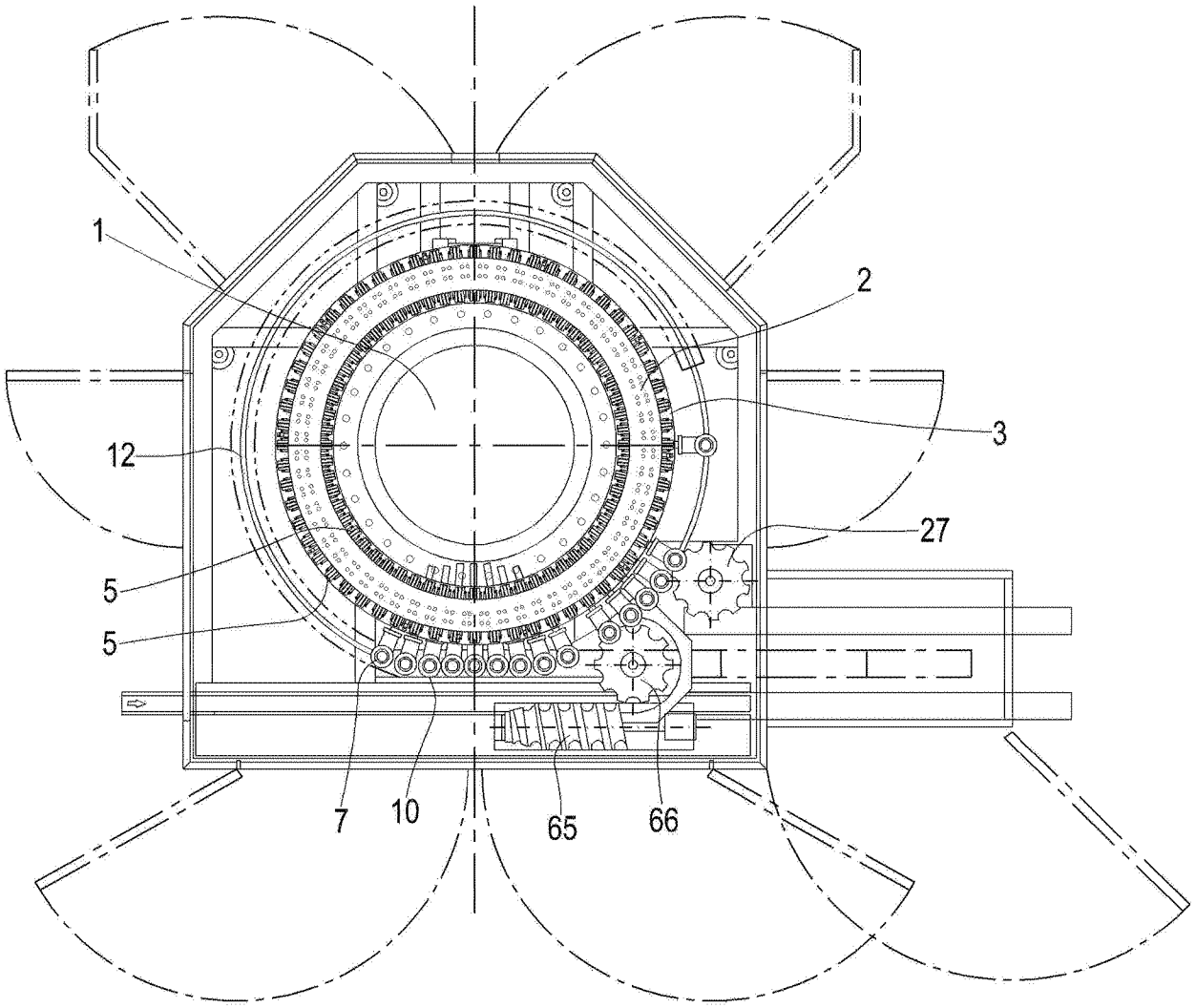
FIG. 1 is a plan view of a plant according to the invention showing the feeding and discharging of cans.
Figure 2:
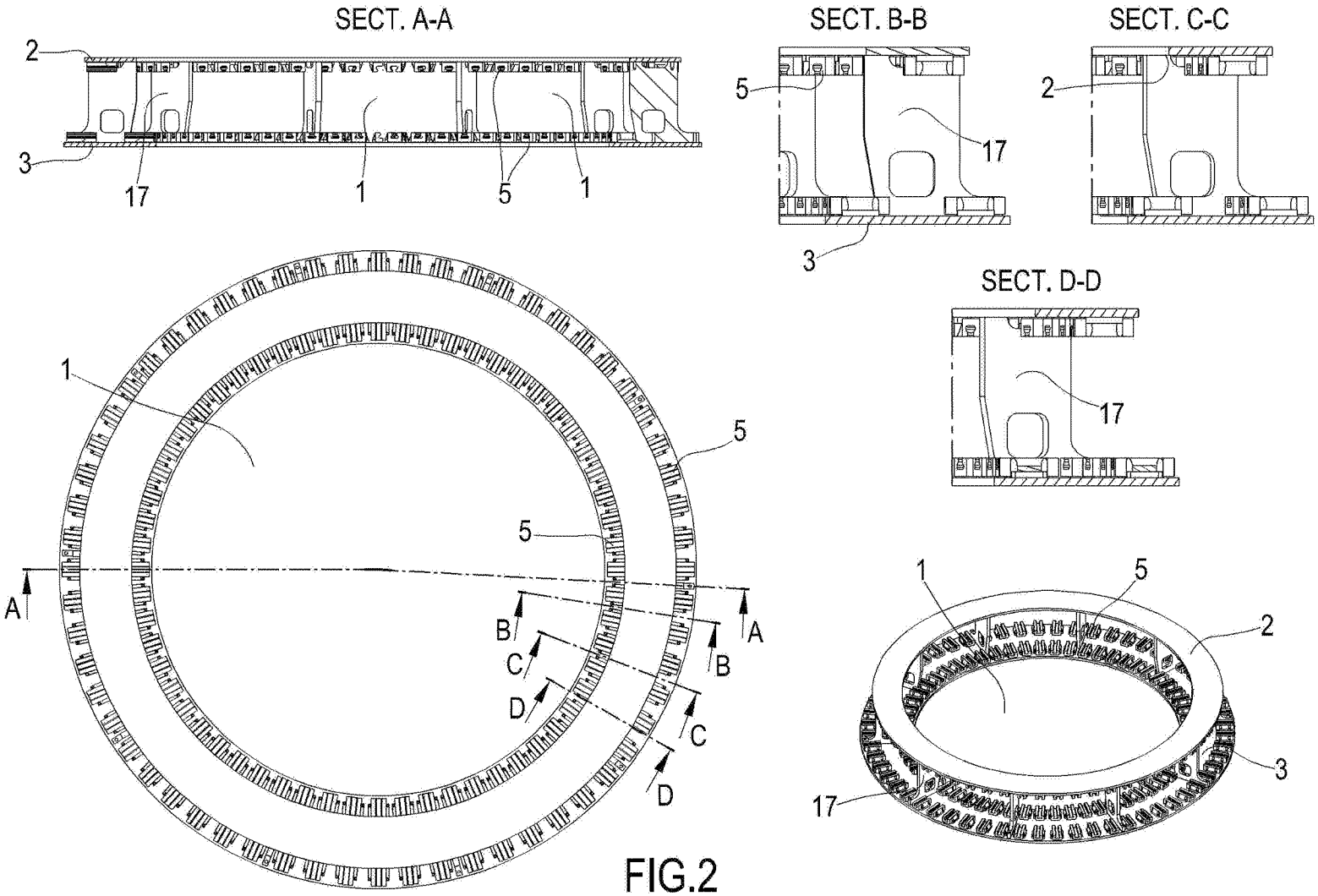
FIG. 2 shows different sections and an axonometric projection of the turntable.
Figure 3:
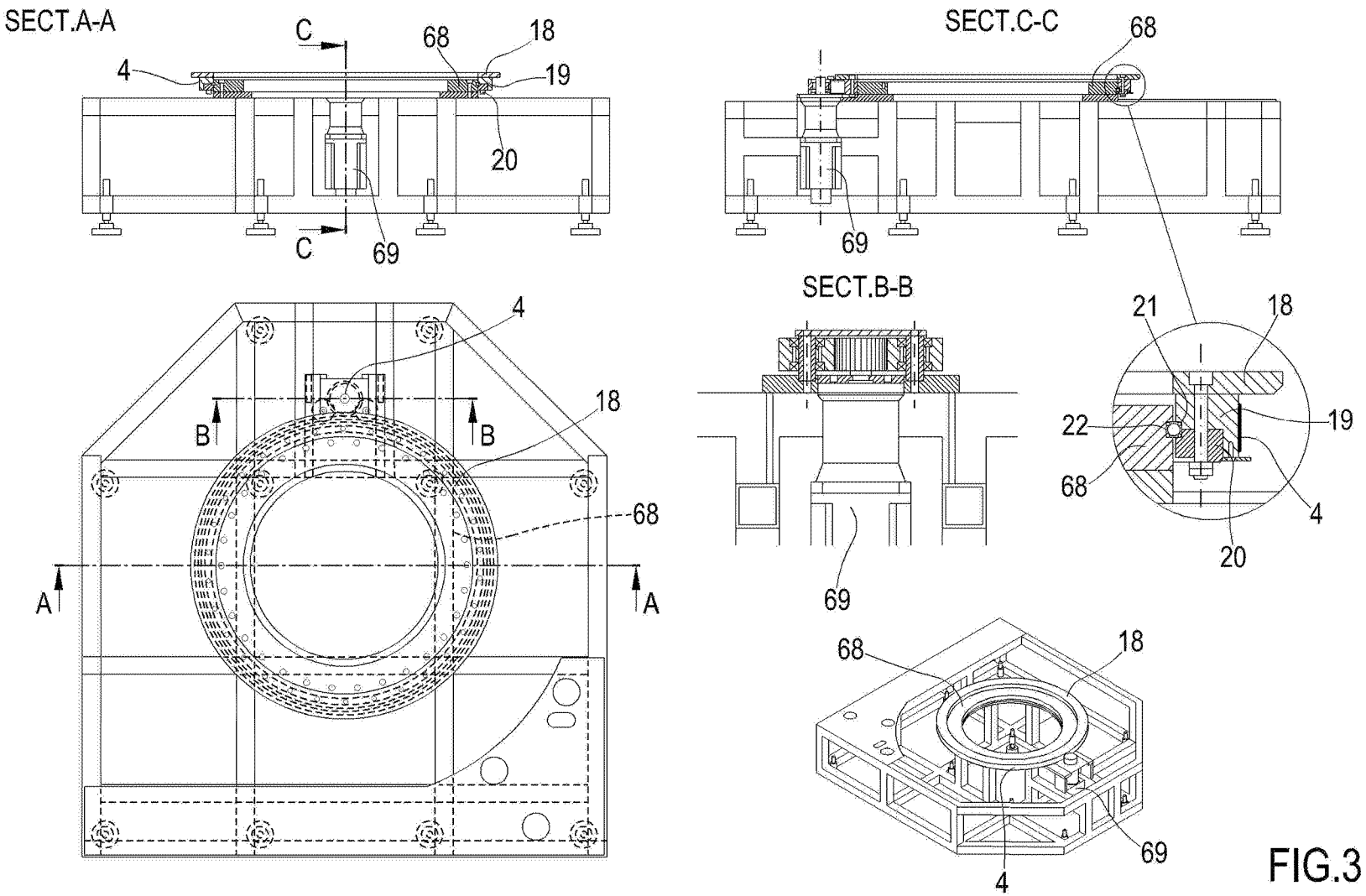
FIG. 3 shows different sections, details and an axonometric projection related to the rotating means of the turntable.
Figure 4:
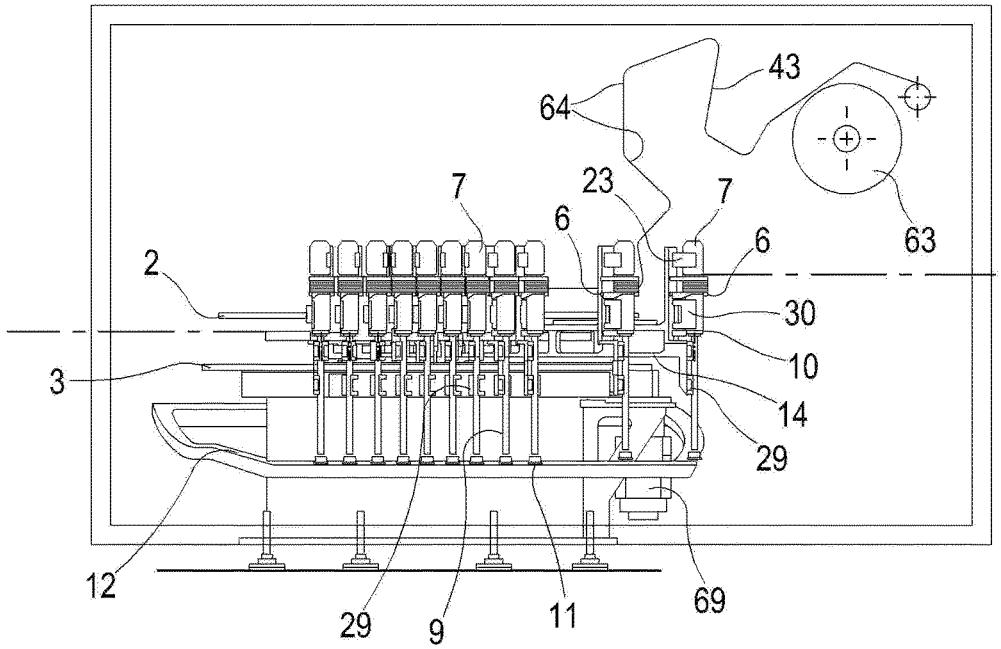
FIG. 4 shows a side view of the movement of the cans and a clear plan section of the plant.
Figure 4:
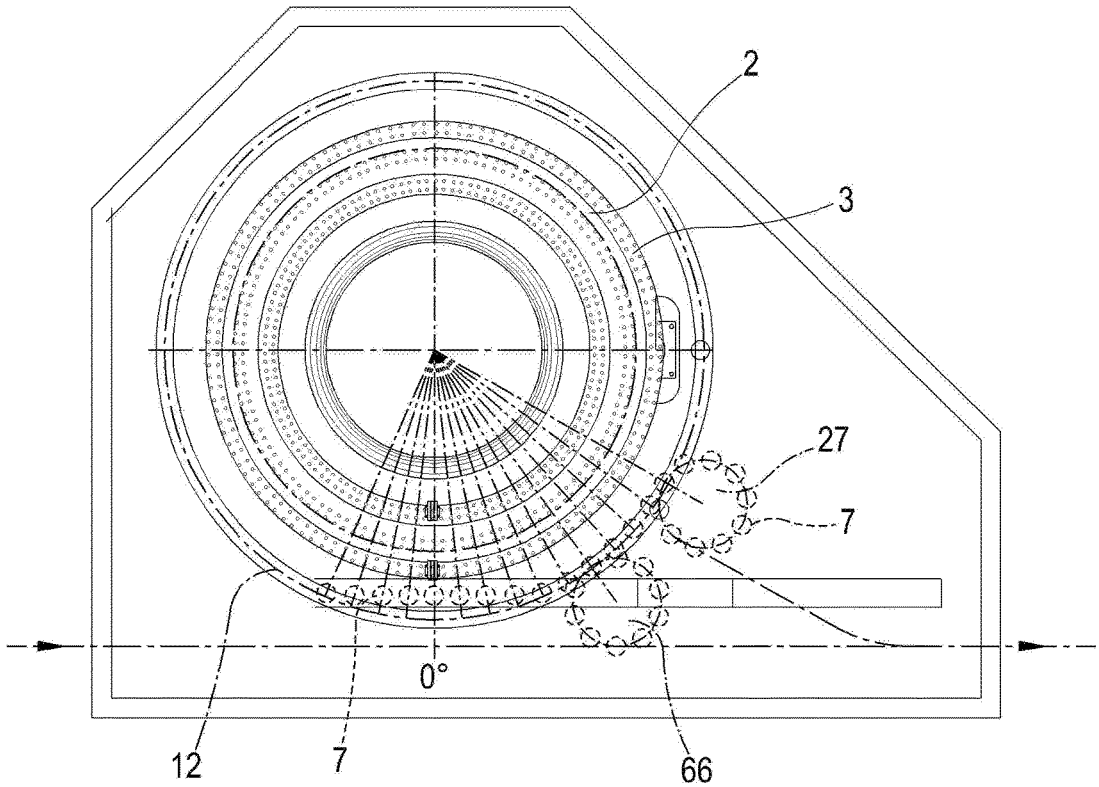
Figure 5:
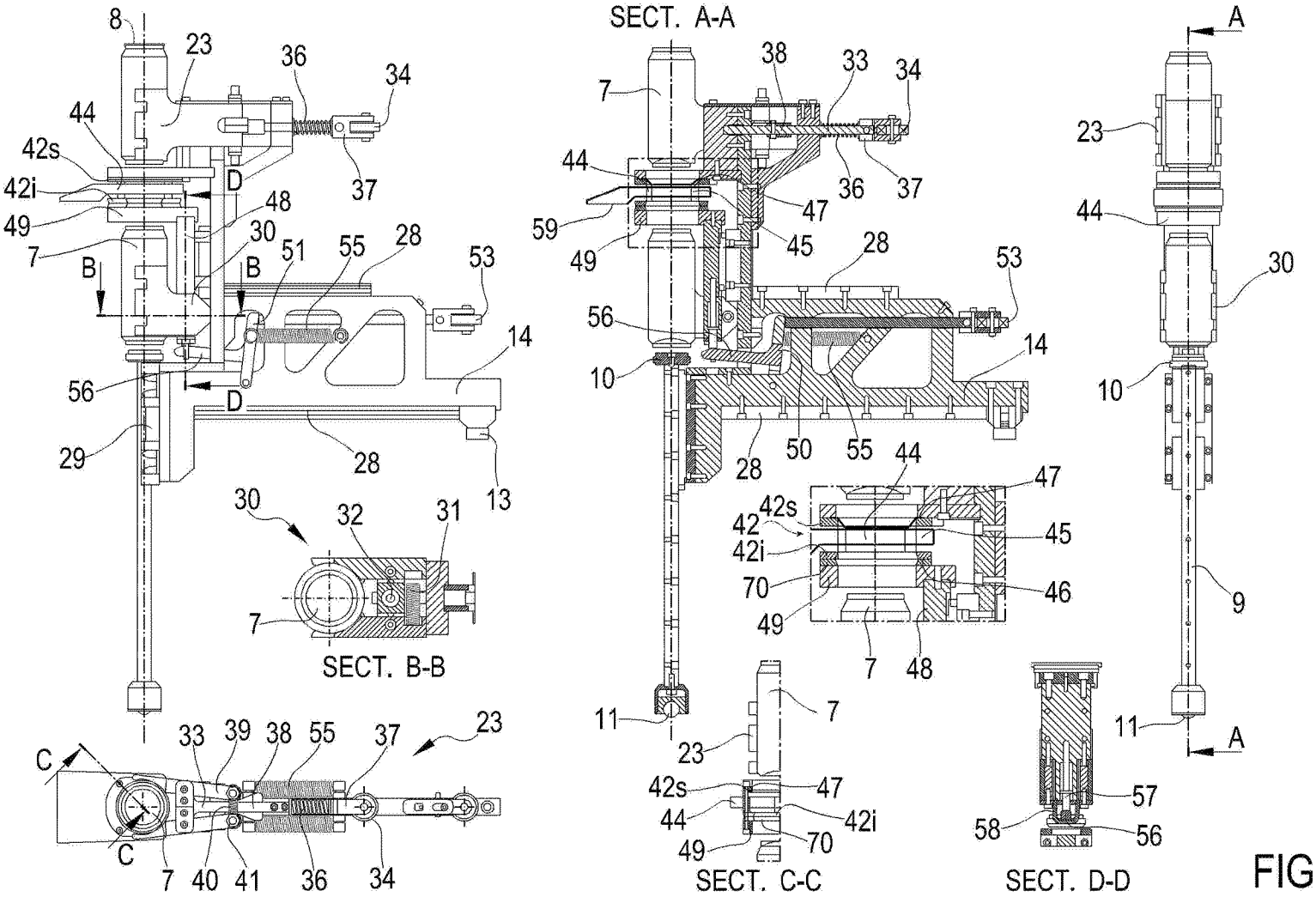
FIG. 5 shows various sections and plans of an operating device.

The invention claimed is:

1. A system for applying a stretchable plastic tape on beverage cans, comprising:

a turntable comprising an upper ring and a lower ring having a common vertical rotation axis, the upper ring and the lower ring being vertically spaced and coupled to one another so to be jointly rotatable;

a first plurality of guides disposed on the upper ring and a second plurality of guides disposes on the lower ring, the guides in the first plurality being vertically aligned with the guides in the second plurality;

a plurality of operating devices, each coupled to a pair of the guides so as to translate circularly together with the turntable, and radially and vertically in relation to the turntable, wherein the pair of the guides comprises one of the guides in the first plurality and one of the guides in the second plurality, and wherein each of the operating devices comprises a lower clamp and an upper clamp that are vertically aligned;

a plurality of rods that translate vertically, wherein an upward translation of one of the rods aligned with the lower and upper clamps causes a beverage can engaged in the lower clamp to be pushed from the lower clamp into the upper clamp, so as to become engaged by the upper clamp, wherein the stretchable plastic tape is interposed between the lower clamp and the upper clamp, and wherein the upward translation of the beverage can causes the stretchable plastic tape to become engaged to an upper rim of the beverage can, so as to form a protective membrane on the beverage can; and a hot air diffuser causing the stretchable plastic tape to become severed from the upper rim of the beverage can, leaving the protective membrane to cover an upper end of the beverage can.

2. The system according to claim 1, wherein the upper ring and the lower ring are coupled to one another by spacing webs.

3. The system according to claim 1, further comprising a motor, and a belt coupled to the motor and the turntable, the motor and the belt causing a rotation of the turntable.

4. The system according to claim 1, wherein each of the operating devices is coupled to the pair of the guides by an upper saddle and a lower saddle that are parallel and respectively engage the one of the guides in the first plurality and the one of the guides in the second plurality, so as to enable the operating device to slide radially within the pair of the guides.

5. The system according to claim 1, wherein each of the operating devices comprises a vertical guide receiving the one of the rods, so as to enable the one of the rods to slide upwardly and downwardly therein.

6. The system according to claim 1, further comprising a track receiving lower ends of the plurality of rods, the track being disposed outside of the turntable and having a varying vertical level, the track operating as a cam that causes the one of the rods to move upwardly toward one of the operating devices, and downwardly away from the one of the operating devices, according to a position of the one of the rods along the track.

7. The system according to claim 6, wherein each of the rods comprises a plate at an upper end, adapted to push a bottom of the beverage can from the lower clamp toward the upper clamp, and a cage at a lower end containing a ball that is rotatable within the cage and in the track receiving the cage.

8. The system according to claim 6, wherein the tracks has a horizontal shape defined by a circular portion and a rectilinear portion coupled to the circular portion.

9. The system according to claim 1, further comprising a gripper interposed between the lower clamp and the upper clamp, the gripper being adapted to engage and stretch the stretchable plastic tape.

10. The system according to claim 9, wherein the gripper comprises a plurality of vertically aligned rings that pinch the stretchable plastic tape and stretch the stretchable plastic tape on the upper rim of the beverage can, the stretchable plastic tape adhering to the upper rim by an annular area reduction caused by a forced radial orientation of molecules of the stretchable plastic tape.

11. The system according to claim 1, wherein the hot air diffuser spreads hot air between the upper clamp and the lower clamp.

12. The system according to claim 1, wherein the upper clamp releases the beverage can with the protective membrane to an area, where a star-rotor removes the beverage can from the system.

* * * * *